US007125150B2

(12) United States Patent
Brun et al.

(10) Patent No.: US 7,125,150 B2
(45) Date of Patent: Oct. 24, 2006

(54) PROJECTOR WITH TRANSVERSE LIGHT SOURCE FOR AUTOMOTIVE VEHICLE

(75) Inventors: Norbert Brun, Guermantes (FR); Jean-Luc Meyrenaud, Livry-Gargan (FR); Kamislav Fadel, Pantin (FR); Xavier Helme-Guizon, Asnières s/Seine (FR)

(73) Assignees: Valeo Vision, Bobigny (FR); Renault S.A.S., Boulogne (FR)

( * ) Notice: Subject to any disclaimer, the term of this patent is extended or adjusted under 35 U.S.C. 154(b) by 162 days.

(21) Appl. No.: 10/743,710

(22) Filed: Dec. 24, 2003
(Under 37 CFR 1.47)

(65) Prior Publication Data

US 2004/0240223 A1 Dec. 2, 2004

(30) Foreign Application Priority Data

Dec. 24, 2002 (FR) ..... 02 16607

(51) Int. Cl.
*F21V 7/00* (2006.01)

(52) U.S. Cl. ..... 362/517; 362/297; 362/346

(58) Field of Classification Search ..... 362/517, 362/518, 346, 538, 297, 299, 300, 304, 215
See application file for complete search history.

(56) References Cited

U.S. PATENT DOCUMENTS

| | | | | |
|---|---|---|---|---|
| 4,180,755 | A * | 12/1979 | Nixon, Jr. | 313/113 |
| 4,241,391 | A * | 12/1980 | Pitkjaan et al. | 362/548 |
| 4,479,072 | A * | 10/1984 | Gaugel et al. | 313/113 |
| 4,569,006 | A * | 2/1986 | Bergin et al. | 362/549 |
| 4,772,987 | A * | 9/1988 | Kretschmer et al. | 362/539 |
| 4,795,388 | A * | 1/1989 | Coliandris et al. | 445/22 |
| 4,885,669 | A * | 12/1989 | Nino | 362/517 |
| 5,967,647 | A * | 10/1999 | Eichler | 362/304 |
| 6,435,703 | B1 | 8/2002 | Takada | |

FOREIGN PATENT DOCUMENTS

| | | |
|---|---|---|
| EP | 0 933 585 | 8/1999 |
| EP | 1 126 210 | 8/2001 |
| FR | 2 808 867 | 11/2001 |

OTHER PUBLICATIONS

Patent Abstracts of Japan, vol. 2000, No. 15, Apr. 6, 2001.

* cited by examiner

*Primary Examiner*—Renee Luebke
*Assistant Examiner*—Gunyoung T. Lee
(74) *Attorney, Agent, or Firm*—Young & Thompson

(57) ABSTRACT

Headlight for a motor vehicle comprising a reflector and a light source (S) running transversely to the optical axis (Y—Y) of the reflector and placed near the focal point of the reflector. The transverse light source (S) is placed near the internal focal point (Fi) of an ellipsoidal reflector (R1). The wall of the ellipsoidal reflector has a cutout (1) situated on one side of the plane passing through the geometric axis of the light source (S) and parallel to the optical axis (Y—Y) of the ellipsoidal reflector. A lens (2) with an optical axis parallel to or coincident with that of the ellipsoidal reflector (R1) is placed in front of this reflector, the focal point (3) of the lens being close to the external focal point (Fe) of the ellipsoidal reflector. A verticalized reflector (R2) is arranged on the opposite side of the cutout (1) to the most-part of the ellipsoidal reflector (R1), this verticalized reflector (R2) being designed to produce, from the source (S) housed in the ellipsoidal reflector, a long-range beam which is not intercepted by the lens, the ellipsoidal reflector giving a wide beam of shorter range.

11 Claims, 2 Drawing Sheets

PROJECTOR WITH TRANSVERSE LIGHT SOURCE FOR AUTOMOTIVE VEHICLE

BACKGROUND OF THE INVENTION

The invention relates to a headlight for a motor vehicle of the kind comprising a reflector and a light source running transversely to the optical axis of the reflector and placed near the focal point of the reflector.

EP 0 933 585 discloses a headlight with a transverse source and a verticalized reflector. The expression "verticalized reflector" is to be understood as meaning a reflector running mainly in the vertical direction and the surface of which is determined such that it reflects, in a substantially horizontal direction, rays of light originating from a source situated near the focal point of the reflector. The headlight according to EP 0 933 585 makes it possible to obtain a beam with a satisfactory range along the optical axis of the projector, with the beam cut off sharply below a horizontal plane.

However, illuminating the shoulders of the highway is a relatively tricky task.

SUMMARY OF THE INVENTION

It is an object of the invention, above all, to provide a headlight which, while at the same time maintaining the advantages afforded by a headlight with a verticalized reflector, makes it possible in a simple and effective way to obtain a wide beam width for illuminating the shoulders.

According to the invention, a headlight for a motor vehicle of the kind defined above is one wherein:

- the transverse light source is placed near the internal focal point of an ellipsoidal reflector;
- the wall of the ellipsoidal reflector has a cutout situated on one side of the plane passing through the geometric axis of the light source and parallel to the optical axis of the ellipsoidal reflector,
- a lens with an optical axis parallel to or coincident with that of the ellipsoidal reflector is placed in front of this reflector, the focal point of the lens being close to the external focal point of the ellipsoidal reflector,
- and a verticalized reflector is arranged on the opposite side of the cutout to the most-part of the ellipsoidal reflector, this verticalized reflector being designed to produce, from the source housed in the ellipsoidal reflector, a long-range beam which is not intercepted by the lens, the ellipsoidal reflector giving a wide beam of shorter range.

The surfaces of the verticalized reflector preferably have a focal point that lies near the light source. The verticalized reflector may have striations delimiting at least one central facet and two lateral facets that are inclined toward one another.

As a preference, the beam produced by the verticalized reflector has an aperture at most equal to ±20° on each side of the optical axis. The beam produced by the ellipsoidal reflector has an aperture of about ±40° on each side of the optical axis.

In general, the plane passing through the transverse axis of the light source and parallel to the optical axis of the ellipsoidal reflector is horizontal. As a preference, the ellipsoidal reflector is situated above this horizontal plane while the verticalized reflector is situated below this plane.

The headlight of the invention may be a dipped-beam headlight for a motor vehicle, in which case the ellipsoidal reflector comprises a cover situated near the external focal point so that the outgoing beam lies essentially below a determined level, while the verticalized reflector is designed to create a V-shaped cutoff corresponding to that of a dipped beam.

The cover may be situated at the focal point or behind the focal point of the ellipsoidal reflector. As a preference, the upper edge of the cover is situated below the horizontal plane passing through the optical axis of the reflector, particularly about 1.5 mm below. The cover may consist of a portion of a cylinder with vertical generatrices, with its concave side facing forward, along the curvature of the field of the ellipsoidal reflector.

The optical axis of the lens is advantageously offset with respect to the optical axis of the ellipsoidal reflector, toward the same side as the cutout.

The lens may be arranged in such a way that its focal point is behind, particularly about 1.5 mm behind, the external focal point of the ellipsoidal reflector.

As an alternative, the ellipsoidal reflector may be situated below the horizontal plane passing through the transverse axis of the light source and parallel to the optical axis of the reflector, while the verticalized headlight is situated above this plane. This arrangement is advantageous when the light source is a discharge bulb.

Apart from the provisions explained hereinabove, the invention consists of a certain number of other provisions that will be dealt with more fully hereinbelow with regard to an exemplary embodiment described with reference to the attached drawings, but which is not in any way limiting.

BRIEF DESCRIPTION OF THE DRAWINGS

In these drawings:

With reference to FIGS. 1 to 3, it is possible to see a headlight P for a motor vehicle comprising a transverse source, S, that is to say one whose geometric axis is horizontal and orthogonal to the optical axis Y—Y of the headlight.

DESCRIPTION OF THE PREFERRED EMBODIMENTS

The source S may consist of a halogen bulb with a filament that is generally cylindrical. In the case of a H1 or H7 standardized bulb with an axial filament, this bulb is mounted transversely in the headlight whereas in the case of a standardized H3 bulb with a transverse filament, this bulb H3 is mounted axially in the headlight.

Figure 1:
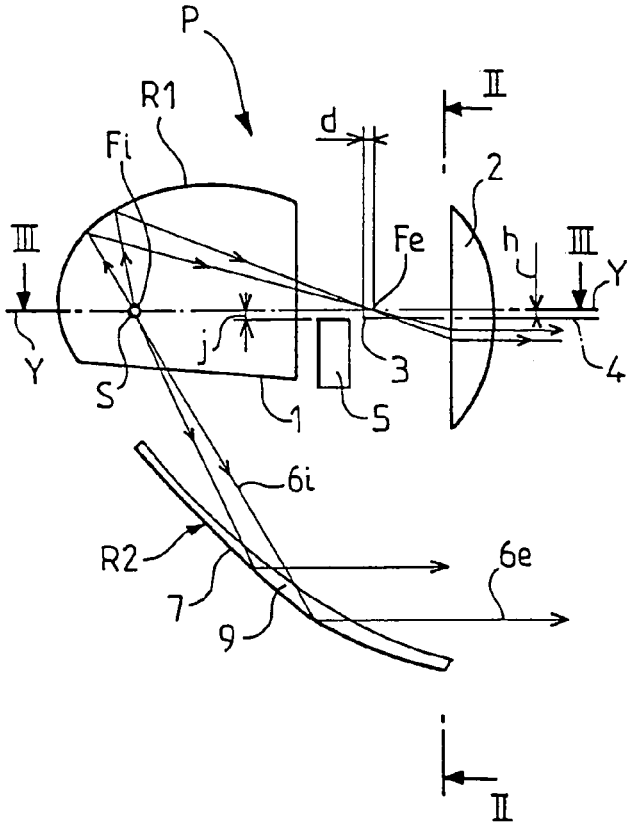
FIG. 1 is a schematic sectional view of a headlight according to the invention, on a vertical plane passing through the optical axis.

As an alternative, the source S may consist of a discharge bulb producing a generally cylindrical arc the mean geometric axis of which is perpendicular to the plane of FIG. 1.

The source S is placed near the internal focal point Fi of an ellipsoidal reflector R1. An "ellipsoidal reflector" is intended to mean a reflector whose surface is defined by two focal points, an internal focal point Fi and an external focal point Fe, respectively, this surface being similar to that of an ellipsoid without necessarily being precisely an ellipsoid.

The wall of the ellipsoidal reflector R1 has a cutout 1 on one side of the plane passing through the geometric axis of the source S and parallel to the optical axis Y—Y. In the example depicted, the plane in question is the horizontal plane passing through the geometric axis of the source S. The cutout 1 corresponds substantially to a cutting-off of the lower half of the reflector R1 along an oblique plane. The plane of section is inclined slightly from left to right in FIG. 1. Viewed in plan, in accordance with FIG. 3, the cutout 1 is bounded by two edges converging toward the rear of the source S. The rear ends of the edges of the cutout 1 are connected by a segment orthogonal to the axis Y—Y. The cutout 1 is designed to allow the maximum amount of light originating from the source S to pass downward, on the opposite side to the most-part of the reflector R1.

The optical axis of the ellipsoidal reflector R1 is coincident with the optical axis Y—Y of the headlight.

A lens 2, with an optical axis parallel to or coincident with the axis Y—Y is placed in front of the reflector R1 in the direction in which the light travels. The diameter of the lens 2 may be about 50 mm. The lens 2 is preferably a low extension lens (by "extension" we mean the distance between the lens and the external focal point Fe of R1).

The accessory elements of the headlight, namely the front glass and the auxiliary equipment for holding the reflector, the lens, the light source and other components, are not depicted because they are known per se.

The focal point 3 of the lens 2 is close to or coincident with the external focal point Fe of the reflector R1. As a preference, the focal point 3 of the lens is behind the external focal point Fe of the reflector R1 by a distance d, particularly of about 1.5 mm.

Advantageously, the optical axis 4 of the lens 2 is situated lower down than the optical axis Y—Y. In particular, the vertical distance h between the optical axis 4 of the lens 2 and the optical axis Y—Y is about 1.5 mm, making it possible to recover more of the stream of light originating from the reflector R1.

The filament of the bulb S may be situated vertically above the internal focal point Fi in order to increase the stream of light originating from the ellipsoidal reflector R1.

Figure 2:
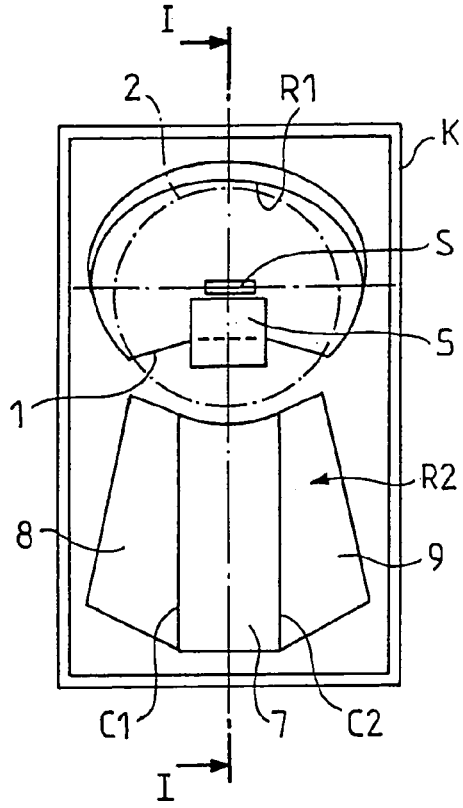
FIG. 2 is a schematic section on II—II of FIG. 1.
Figure 3:
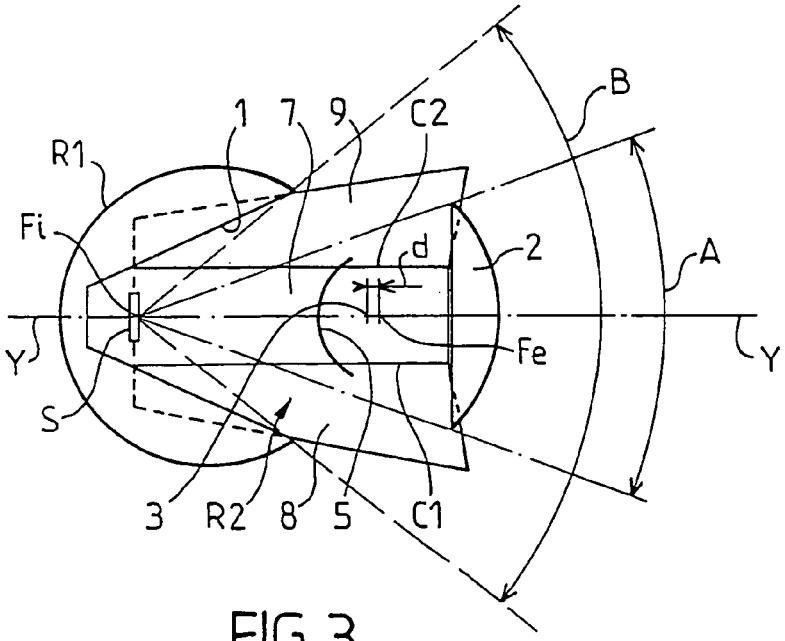
FIG. 3 is a schematic section on III—III of FIG. 1.

In the case depicted in FIGS. 1 to 3, the headlight P is designed to provide the dipped-beam function, that is to say to provide a beam suitable for passing oncoming traffic. In order to prevent the beam of light originating from the reflector R1 having a part situated above the horizontal plane passing through the axis Y—Y, a cover 5 is arranged near the external focal point Fe. The cover 5 consists of an opaque plate, for example made of metal, held by any appropriate means. Because of the curvature of the field, the cover 5 forms a portion of cylindrical surface with vertical generatrices with its concave face facing forward. Advantageously, the upper edge of the cover 5 is situated below the horizontal plane passing through Y—Y, at a distance J of about 1.5 mm.

A verticalized reflector R2 is arranged on the opposite side of the cutout 1 to the most-part of the ellipsoidal reflector R1. The intersection between this verticalized reflector R2 and a vertical plane passing through the axis Y—Y consists of an arc of a curve similar to an arc of a parabola having a focal point near the internal focal point Fi. In general, the surface of the reflector R2 is determined such that a ray of light such as 6*i* originating from the source S is reflected at 6*e* in a direction parallel or substantially parallel to the axis Y—Y.

The verticalized reflector R2 is designed to give images of the source S that are centered on the axis Y—Y at infinity, that is to say at a distance of several tens of meters from the headlight.

Furthermore, the verticalized reflector R2 is designed to concentrate the beam that it reflects into an aperture A (FIG. 3) of at most ±20° on each side of the optical axis Y—Y. The reflector R2 may have striations C1, C2 determining at least three facets, namely a central facet 7 consisting of a portion of cylindrical surface, the generatrices of which are horizontal and perpendicular to the plane of FIG. 1, and two lateral facets 8, 9, bent slightly toward one another with respect to the central facet 7. The central facet 7 of the verticalized reflector essentially contributes to the range of the beam while the lateral facets 8, 9 contribute to widening the beam reflected by R2.

The housing K of the headlight, depicted schematically in FIG. 2 with a rectangular outline, may be taller than it is wide.

The ellipsoidal reflector R1 produces a light beam with an aperture B (FIG. 3) of about ±40° on each side of the optical axis Y—Y.

In the example considered, of a headlight P intended to produce a dipped beam, the verticalized reflector R2 is designed to establish the V-shaped cutoff line corresponding to the legislation governing dipped-beam headlights, as will be described with regard to FIG. 5.

The working of the headlight P is as follows.

When the light source S is in operation, the ellipsoidal reflector R1 produces a short-range but very wide beam to illuminate the shoulders.

Figure 4:
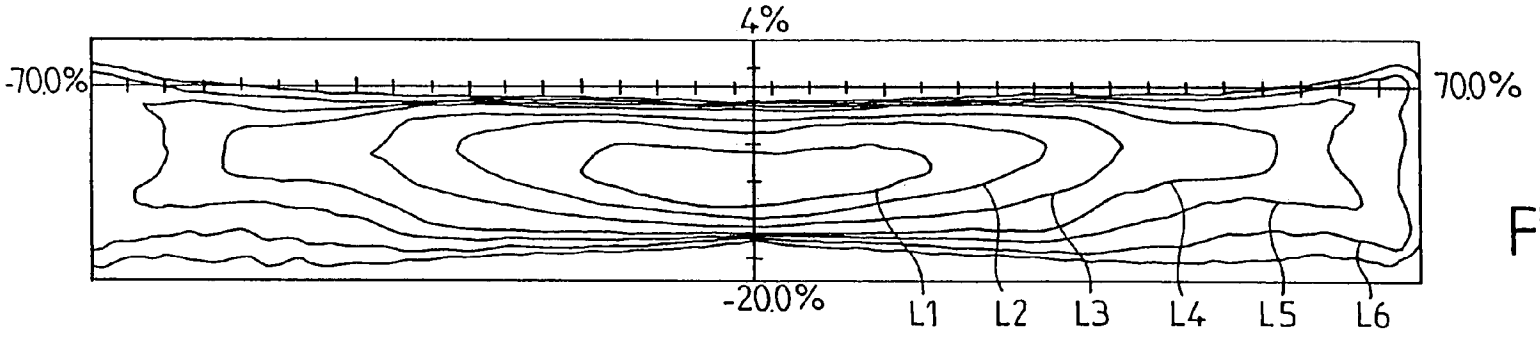
FIG. 4 illustrates the photometry of the ellipsoidal reflector.

Isolux curves of the illumination of this beam on a screen perpendicular to the optical axis Y—Y and situated 25 m from the headlight are depicted in FIG. 4 for a specific nonlimiting example. The X-axis corresponds to the plot on the screen of the horizontal plane passing through the optical axis Y—Y of the headlight. The graduations in % (percent) on this axis correspond to the tangent of the angle formed between the optical axis and the straight line passing through the focal point of the headlight and intersecting the screen at the graduation. The Y-axis corresponds to the plot on the screen of the vertical plane passing through the optical axis Y—Y. The graduations in % (percent) on this vertical axis correspond to the tangent of the angle formed between the horizontal plane passing through the optical axis and a straight line that passes through the focal point of the headlight and intersects the screen at the graduation.

It can be seen from FIG. 4 that the isolux curves of the beam produced by the reflector R1 lie essentially below the horizontal plane passing through the optical axis Y—Y. The closed curve L1 of maximum illumination is entirely situated below the horizontal plane and is substantially symmetric with respect to the vertical axis. This curve L1 is surrounded by a series of closed curves corresponding to increasingly weak illuminations. Some of these curves extend sideways out to ±70% (which corresponds to angles of about ±35°/tan 35°≃0.7), The isolux curve L1 corresponds, in the example considered, to an illumination of 6 lux. The maximum illumination is at the center of this curve. The next isolux curves correspond to illuminations which diminish gradually: 3.2 lux in the case of L2, 1.6 lux in the case of L3, 0.7 lux in the case of L4, 0.4 lux, in the case of L5, and 0.2 lux for L6.

According to FIG. 4, the total flux of the beam produced by the ellipsoidal reflector R1 is about 254 lumen.

Figure 5:
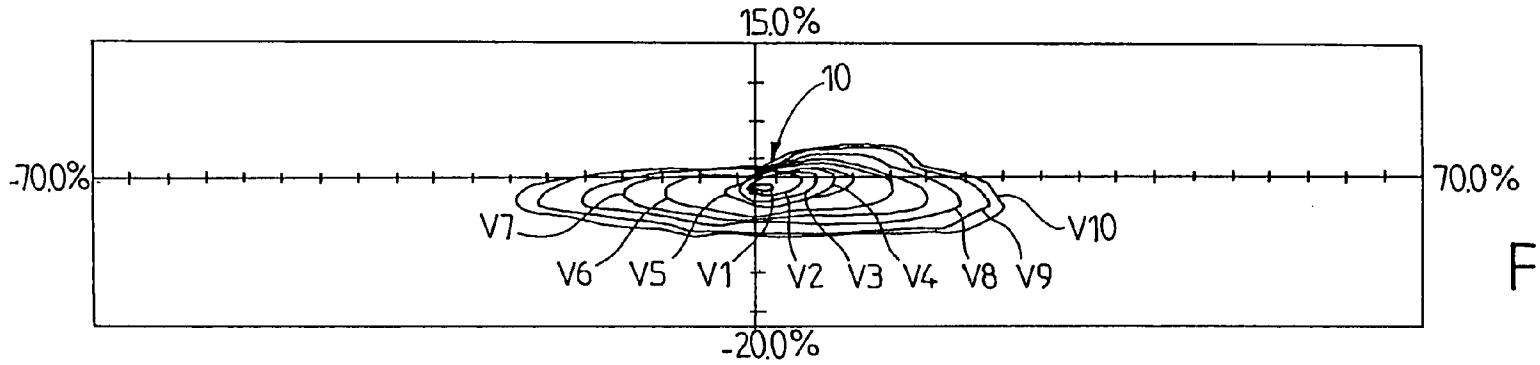
FIG. 5 illustrates the photometry of the verticalized reflector.

FIG. 5 depicts, for the example considered, the isolux curves for the light beam produced by the verticalized reflector R2 alone. The beam is more concentrated than the beam in FIG. 4 with a V-shaped cutoff line substantially horizontal to the left of the x-axis and rising, to the right, in the form of an inclined branch 10. The closed isolux curve of greatest illumination V1 is crossed by the vertical axis and extends a little further to the right than to the left, as do the other isolux curves. This curve V1 corresponds to an illumination of 32 lux. The next isolux curves V2, V3, V4, V5, V6, V7, V8, V9 and V10 correspond respectively to levels of 24 lux, 20 lux, 16 lux, 12 lux, 6 lux, 3.2 lux, 1.6 lux, 0.7 lux and 0.4 lux.

The strong illumination of this beam along the axis explains the range that is greater than that of the broader beam (FIG. 4) of the ellipsoidal reflector.

Figure 6:
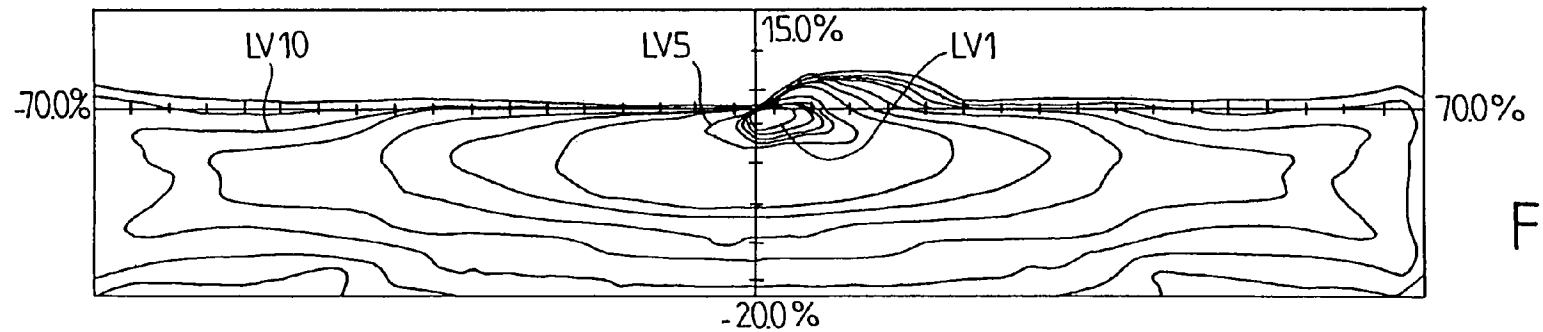
FIG. 6 illustrates the photometry of the headlight as a whole.

FIG. 6 illustrates the isolux curves of the headlight which are obtained by adding together the respective beams of the ellipsoidal reflector R1 and of the verticalized reflector R2. Still in the example considered, the central isolux curve LV1 corresponds to a level of 32 lux. The next curves which surround it correspond to gradually diminishing levels. The curve LV5 corresponds to a level of 12 lux and the curve LV10 to a level of 0.4 lux.

The curves of FIG. 6 indeed correspond to a dipped beam of light situated, in the case of the left-hand part, essentially below the horizontal plane passing through the optical axis, with an oblique cutoff line on the right-hand part rising up above the horizontal.

In the foregoing description, the ellipsoidal reflector R1 is situated mainly above the horizontal plane passing through the optical axis Y—Y of the headlight, the cutout 1 being situated below this plane, as is the verticalized reflector R2.

A reverse arrangement is possible, that is to say an arrangement where the verticalized reflector R2 is situated above the horizontal plane passing through the axis Y—Y and the ellipsoidal reflector R1 is, for the most part, situated below this plane. The cutout of the reflector R1 would then lie above the horizontal plane passing through Y—Y. In such a reverse arrangement, the reflecting surfaces are recalculated to provide the desired beams. Such a reverse arrangement is particularly suited to a light source S consisting of a discharge bulb.

The invention applies not only to a dipped-beam headlight P like the one described, but also to other types of headlight, particularly a full-beam headlight. In the latter instance, the cover 5 would be omitted and there would be no need to provide cutoff lines for the beams of light.

The presence of the verticalized reflector R2 makes it possible, in the case of a dipped-beam headlight with cover 5, to achieve better yield in terms of flux by comparison with a headlight having just one complete ellipsoidal reflector. The gain in flux is of the order of 25% because the beam of light produced by the verticalized reflector R2 is not diminished by the cover 5.

With a conventional verticalized reflector alone, it was relatively difficult to achieve the beam width and it was necessary to use reflections off the cheeks of the mirror. These difficulties disappear with the solution of the invention because the ellipsoidal reflector R1 performs the spreading.

The invention claimed is:

1. A headlight for a motor vehicle comprising:

a reflector and a light source running transversely to an optical axis of the reflector, wherein:

the reflector is an ellipsoidal reflector and the transverse light source is placed near an internal focal point of the ellipsoidal reflector;

a wall of the ellipsoidal reflector has a cutout situated on one side of a plane passing through a geometric axis of the light source and parallel to the optical axis of the ellipsoidal reflector, a lens with an optical axis parallel to or coincident with that of the ellipsoidal reflector is placed in front of the reflector, a focal point of the lens being close to an external focal point of the ellipsoidal reflector, and a verticalized reflector is arranged on a side of the cutout opposite to the most-part of the ellipsoidal reflector, this verticalized reflector being designed to produce, from the light source housed in the ellipsoidal reflector, a long-range beam which is not intercepted by the lens, the ellipsoidal reflector giving a wide beam of shorter range, said verticalized reflector having striations delimiting at least one central facet and two lateral facets that are inclined toward one another, wherein the verticalized reflector is separated from said ellipsoidal reflector by a gap.

2. The headlight as claimed in claim 1, wherein surfaces of the verticalized reflector have a focal point that lies near the light source.

3. The headlight as claimed in claim 1, wherein the beam produced by the verticalized reflector has an aperture at most equal to ±20° on each side of the optical axis of the ellipsoidal reflector.

4. The headlight as claimed in claim 1, wherein the beam produced by the ellipsoidal reflector has an aperture of about ±40° on each side of the optical axis of the ellipsoidal reflector.

5. The headlight as claimed in claim 1, in which a plane passing through a transverse axis of the light source and parallel to the optical axis of the ellipsoidal reflector is horizontal, wherein the ellipsoidal reflector is situated above this horizontal plane while the verticalized reflector is situated below this plane.

6. A dipped-beam headlight as claimed in claim 1, wherein the ellipsoidal reflector comprises a cover situated near the external focal point so that the outgoing beam lies essentially below a determined level, while the verticalized reflector is designed to create a V-shaped cutoff corresponding to that of a dipped beam.

7. The dipped-beam headlight as claimed in claim 6, wherein an upper edge of the cover is situated below a horizontal plane passing through the optical axis of the reflector.

8. The headlight as claimed in claim 1, wherein the optical axis of the lens is offset with respect to the optical axis of the ellipsoidal reflector, toward the same side as the cutout.

9. The headlight as claimed in claim 1, wherein the lens is arranged in such a way that its focal point is behind the external focal point of the ellipsoidal reflector.

10. The headlight as claimed in claim 1, in which a plane passing through a transverse axis of the light source and parallel to the optical axis of the ellipsoidal reflector is horizontal, wherein the ellipsoidal reflector is situated below the horizontal plane passing through the transverse axis of the light source and parallel to the optical axis of the reflector, while the verticalized reflector is situated above this plane.

11. The headlight as claimed in claim 10, wherein the light source is a discharge bulb.

* * * * *